US005249374A

United States Patent [19]

Henningsen et al.

[11] Patent Number: 5,249,374

[45] Date of Patent: Oct. 5, 1993

[54] APPARATUS FOR CONTINUOUSLY DRYING AND SHRINKING LENGTHS OF TEXTILE MATERIAL

[75] Inventors: Erik Henningsen, Værløse; Jeppe Stigsen, Frederiksberg; Helge Christensen, Hillerød, all of Denmark

[73] Assignee: Vald. Henriksen A/S, Soborg, Denmark

[21] Appl. No.: 822,613

[22] Filed: Jan. 17, 1992

[30] Foreign Application Priority Data

Jan. 21, 1991 [DK] Denmark ..... 0096/91

[51] Int. Cl.[5] ..... F26B 13/00

[52] U.S. Cl. ..... 34/213; 34/155; 8/149.2; 26/18.5; 68/5 D

[58] Field of Search ..... 34/23, 155, 212, 209, 34/210, 12, 62, 213; 26/18.5; 8/149.1-149.2; 68/5 C, 5 D

[56] References Cited

U.S. PATENT DOCUMENTS

| | | | |
|---|---|---|---|
| 1,841,927 | 1/1932 | Allsop | 34/213 |
| 2,431,372 | 11/1947 | Cook et al. | 26/18.5 |
| 4,006,612 | 2/1977 | Thies | 68/177 |
| 4,121,311 | 10/1978 | Meyer | 34/191 |
| 4,137,648 | 2/1979 | Rhodes | 34/212 |
| 4,270,283 | 6/1981 | Ellis | 34/212 |
| 4,345,385 | 8/1982 | Sando et al. | 34/155 |
| 4,492,045 | 1/1985 | Boucraut | 26/18.5 |
| 4,829,620 | 5/1989 | Christ et al. | 8/149.1 |
| 4,885,814 | 12/1989 | von der Eltz et al. | 8/149.1 |
| 4,903,509 | 2/1990 | Christ et al. | 68/5 C |
| 4,947,660 | 8/1990 | von der Eltz ete al. | 68/62 |
| 5,062,220 | 11/1991 | Keilhack | 34/162 |

*Primary Examiner*—Henry A. Bennet
*Assistant Examiner*—Denise L. F. Gromada
*Attorney, Agent, or Firm*—Scully, Scott, Murphy & Presser

[57] ABSTRACT

An apparatus for continuously drying and shrinking lengths of textile material (111) comprises a plurality of chambers (21 to 44), in which the textile material (111) is sucked through an inlet by means of drying air and carried along a treatment path to an outlet. The textile material is advanced to the inlet by means of a rotating winch. The chambers (21 to 44) are interconnected in series providing a treatment path for the textile material (111). The textile material is carried in sequence from the outlet of one chamber to the inlet of the succeeding chamber. The chambers (21 to 44) are arranged in succeeding, mutually separated groups (21 to 27, 28 to 35, 36 to 43, and 44), each group comprising an air feeding device (90) feeding heated drying air substantially to all its inlets (50), said air feeding device receiving air from all the succeeding groups.

3 Claims, 3 Drawing Sheets

APPARATUS FOR CONTINUOUSLY DRYING AND SHRINKING LENGTHS OF TEXTILE MATERIAL

FIELD OF THE INVENTION

The invention relates to an apparatus for continuously drying and shrinking lengths of textile material, said apparatus comprising a plurality of chambers, in which the textile material is sucked through an inlet by means of drying air and carried along a treatment path to an outlet, and an air feeding device feeding heated drying air to the inlet of the chamber, the textile material being advanced to said inlet by means of a rotating winch.

BACKGROUND ART

Today textile materials for clothing are required to possess a good handle, i.e. they must be soft and pleasant to touch. In addition, the rest shrinkage values must be low, and the surface of the woven articles must present a washed-out, slightly crumpled character. The textile materials should as far as possible also be free of softening and finishing agents.

These requirements were previously fulfilled by means of rotating tumblers or other apparatuses for treatment of separate lengths of textile material, where said textile material was treated mechanically and by means of passing hot drying air. Attempts have also been made at achieving the same effect by way of a continuous process, but without success. According to the most well-known solutions the fabric is spread out and carried through either a channel between two chambers or through a treatment zone in which the fabric is subjected to varying air flows while supported on a conveyor in form of an open network.

In this manner it is possible to achieve a slight ventilation, and a few of the solutions ensure also a good rest shrinkage value, but the resulting fabric remains flat and without the desired handle.

Attempts have also been made at imitating the tumbler system by means of an elongated cylindrical, almost horizontally arranged drum, where the fabric is loaded at one end and unloaded at the opposite end, said fabric being mechanically processed by allowing the drum to oscillate about its longitudinal axis while simultaneously being blown through by means of air.

SUMMARY OF THE INVENTION

The apparatus according to the invention is characterized in that the chambers comprise a plurality of substantially identical chambers arranged in parallel and interconnected in series, whereby all the chambers form a treatment path for the textile material, and where said chambers are interconnected in such a manner that the textile material is carried in sequence from the outlet of one chamber to the inlet of the succeeding chamber, and wherein said chambers are arranged in succeeding, mutually separated groups, each group including at least one chamber, and wherein each group comprises an air feeding device feeding heated drying air substantially to all the inlets of the chambers of each group, said air feeding device receiving air from all the chambers of the succeeding group.

The resulting textile material is easy to guide and present a uniform result in a relatively inexpensive manner. In addition, the apparatus is of a relatively small size because it is relatively uniformly structured and allow the air to pass therethrough in a counterstream-like manner with the result that the fed air is efficiently utilized. After having passed the apparatus, the drying air possesses a high moisture percentage, which means that the consumption of air is relatively restricted.

According to the invention the last chamber of the plurality of chambers may be separated from the remaining chambers when seen in the moving direction of the textile material and be provided with a cooling grating, the textile material being carried across said cooling grating before it is pulled out of the chamber, and the suction air to the air feeding device of the last and the last but one group of chambers may be sucked in from the outside substantially in form of cold air through the last chamber and the cooling grating thereof. In this manner the textile material is efficiently cooled before it leaves the apparatus, and the heat in said textile material is simultaneously utilized for the initial heating of the fresh air. Accordingly additional energy is saved beyond the energy saved by allowing the reused drying air to pass through the apparatus in a counterstream-like manner.

According to the invention it is particularly advantageous when the inlet of each chamber comprises a substantially vertically downward extending nozzle placed below the associated winch and fed with drying air in form of downward jets along the circumference, and a channel with an inlet opening placed immediately below the nozzle and continuing through a curve into an upwardly inclining portion, in which the loosely flapping textile material is advanced by means of the drying air while striking against the walls of the channel, and when each chamber comprises a chute inclining obliquely downwards from a level immediately below the outlet of the channel towards the bottom of the chamber in a direction backwards again towards an area substantially vertically below the nozzle in the inlet of the succeeding chamber.

In this manner an efficient conveying of the textile material is ensured by means of the drying air and the gravity, at the same time as an efficient mechanical treatment of the textile material is ensured.

Finally according to the invention, the chambers of substantially each group of chambers may comprise a common bottom allowing the drying air to be sucked away for reuse or into the atmosphere.

BRIEF DESCRIPTION OF THE DRAWINGS

The invention is described in greater detail below with reference to the accompanying drawings, in which.

DESCRIPTION OF THE PREFERRED EMBODIMENTS

Figure 1:
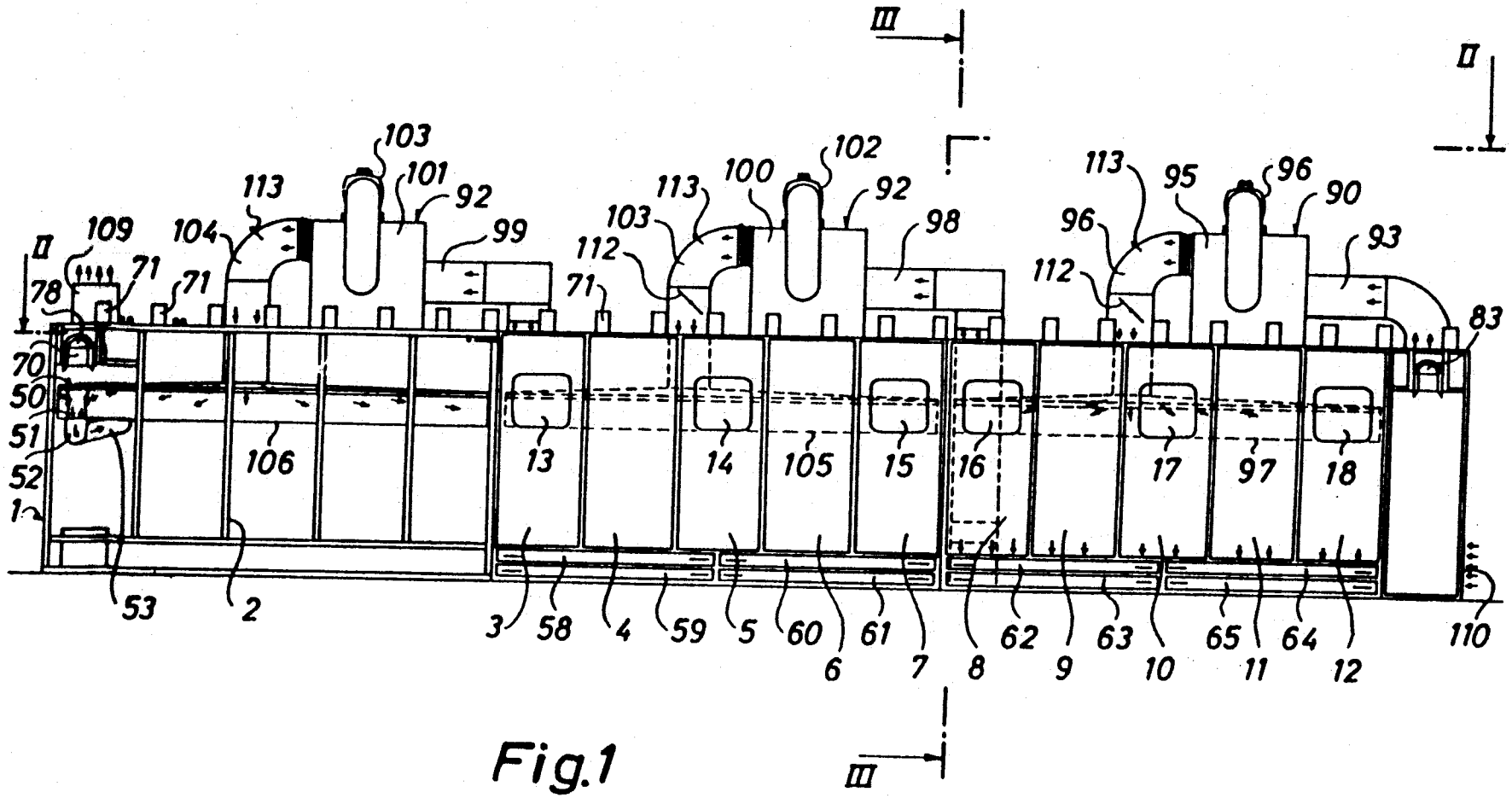
FIG. 1 is a diagrammatic side view of an apparatus according to the invention and comprising chambers separated in groups, where the wall into the first group of chambers has been omitted for the sake of clarity, and where only details of the chamber placed farthest to the left appear for the sake of clarity.

The apparatus illustrated in the drawings comprises an outer, heat-insulated housing provided with the general reference numeral 1. The housing I comprises a frame structure, on which a plurality of plate members 3 to 12 are mounted. Some of the plate members are permanently fixed and provided with windows 13 to 18, whereas other plate members can be opened. The housing is furthermore sealed along all its sides, but in FIG. 1 some of the plate members have been removed for the sake of clarity.

Figure 2:
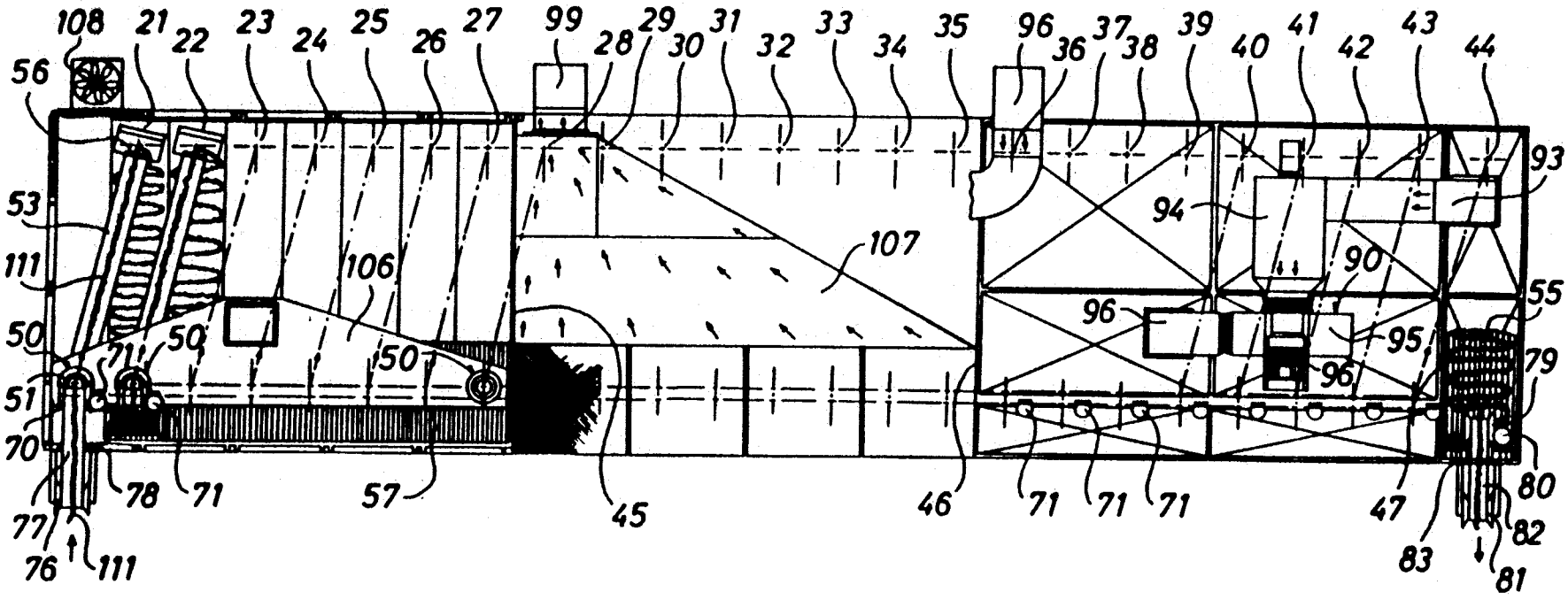
FIG. 2 is a sectional view of the apparatus of FIG. 1 taken along the line II—II of FIG. 1, but whereby parts have been omitted for the sake of clarity.

A plurality of chambers 21 to 44 are provided inside the housing 1, several of said chambers only being indicated in FIG. 2. Only the chambers 21 and 22 are illustrated in details. The remaining chambers are identical with the chambers 21 and 22 and are arranged in groups in such a manner that the chambers 21 to 27 are separated from the chambers 28 to 35 by means of a sealing partition 45, and the chambers 28 to 35 are separated from the chambers 36 to 43 by means of a sealing partition 46. A sealing partition 47 is also provided between the chambers 43 and 44. Each chamber, such as the chamber 21, comprises an inlet provided with the general reference numeral 50. Said inlet comprises an annular nozzle 51, which in turn comprises three coaxially arranged conic lengths of pipe, cf. FIG. 1. The lengths of pipe are arranged at a mutual axial distance in such a manner that circumferential inlet passages for the drying air are formed. The axis of the annular nozzle is vertically arranged, and the circumferential slots are arranged in such a manner that the drying air passes downwards into the annular nozzle 51. The annular nozzle opens into the inlet opening 52 of a tubular channel 53. The tubular channel continues through a curved portion 54, cf. FIG. 3, into a rectilinear portion inclining upwards from one side of the housing 1 of the apparatus to the opposite side and ending centrally above the respective chamber 21 to 44. A chute 55 is provided below the channel 53, said chute extending from the area immediately below the outlet opening 56 of the channel 53 and downwards towards the bottom of the chamber 21 to 44 in the area below the nozzle 51 in the inlet 50 of the succeeding chamber, when seen from the left to the right in FIGS. 1 and 2.

As mentioned, all the chambers 21 to 44 are identical, all chambers comprising an inlet 50 with a nozzle 51, a channel 53, and a chute 55. Apart from the chute in the chamber 44 shown farthest to the right in FIGS. 1 and 2, all the chutes are made of a smooth sheet material. The chute in the chamber 44 is formed as a grating with flow passages for air. In all the chambers the bottom 57 is formed by a grating as well. Apart from the last chamber 44, the bottom 57 of all the chambers is arranged above drawers 58 to 65, cf. FIG. 1, with filters 65 and 66, cf. FIG. 3.

A rotatably journalled winch is provided immediately above the nozzle 51 in the inlet 50 of each chamber 21 to 44, cf. the winch 70 at the inlet of the first chamber 21. Each winch 70 is rotated by means of its own motor 71 having three adjustment possibilities. The motor can, of course, be stopped. In addition it can operate at both a low or a high speed in response to the position of a damper-like sensor 72, cf. FIG. 3. The sensor is pivotally arranged immediately adjacent the bottom 57 of each chamber and communicates through a drawbar 73 with an adjustment device 74 for the motor 71. The motor is automatically set to operate at the desired speed in response to the angular position of the sensor 72 about a horizontal axis 75 of rotation.

In addition to the winches 70 arranged above the inlet of each chamber 21 to 44 within the walls of the housing 1, a rotatably journalled winch 76 is provided outside the housing 1 levelling with and opposing the winch 70 associated with the first chamber 21. A conveyor band 77 is arranged about the two winches 70 and 76, said conveyor band passing through an opening 78 allowing introduction of the textile material into the apparatus. Correspondingly, the last chamber 44 is provided with a winch 79 mounted inside the housing and substantially levelling with the other winches 70. The winch 79 is driven by a motor 80.

A rotatable winch 81 is also provided outside the housing 1 on a level with the winch 78. A conveyor band 82 is mounted about these two winches 79 and 81, said conveyor band passing through an opeing 83 in the wall of the housing 1, said wall allowing the textile material to leave the apparatus.

An air feeding device is mounted on the apparatus for each group of chambers, said air feeding device being designated the general reference numeral 90, 91, and 92. The air feeding device 90 associated with the group of chambers 36 to 44 comprises an air suction tube 93 connected to the ceiling of the chamber 44 for the suction in of air therefrom. The air continues from the suction tube 93 through a heating device 94 to a blower 95 driven by a motor 96. The blower 95 sends the heated air through an air feeding channel 96 downwards into an air distribution channel 97, said channel 97 only being indicated by dotted lines in FIG. 1. The air distribution channel 97 surrounds the nozzle 51 of all the chambers 36 to 44 associated with the group in question. The drying air flows from the distribution channel 97 into the nozzles 51 through the circumferential slots therein.

The remaining two air feeding devices 91 and 92 are shaped in the same manner as the air feeding device 90. Accordingly, these two devices also comprise their respective air suction tube 98 and 99, a heating device, a blower 100 and 101 with their respective motor 102 and 103, as well as an air feeding channel 103 and 104, respectively. The air feeding channels 103 and 104 continue into their respective air distribution channel 105 and 106, respectively, surrounding their respective group of nozzles 51. The air distribution channel 105 is indicated by dotted lines in the drawing, whereas the air distribution channel 106 feeding air to the nozzles associated with the chambers 21 to 28 is shown by means of solid lines. All the air distribution channels are structured in the same manner.

The air suction tubes 98 and 99 associated with the air feeding devices 91 and 92 communicate unlike the air suction tube 93 of the first air feeding device 90 with their respective air collection channel 107 positioned at the bottom of the associated chambers. The drawing shows only the air collecting channel 107 associated with the chambers 28 to 35 and communicating with the air suction tube 99 of the air feeding device 92. The air collection channel of the second air feeding device 91 is structured in the same manner and is provided at the bottom of the chambers 36 to 43. A corresponding, not shown air collection channel is provided below the chambers 21 to 27, said air collection channel communicating with a blower 108 and an air outlet opening 109 associated with said blower, cf. FIG. 2 and FIG. 1, respectively. Subsequently, the air can be let out into the atmosphere or be returned to the last chamber 44, in which an air inlet opening 110 for fresh air is provided in the bottom below the grating-shaped chute 55 and the bottom 57.

All the air collection channels 107 at the bottom of the chambers are arranged so that the air flows from the chambers into the air collection channel 107 through the filters 65, 66.

During the returning, if any, of the air from the air outlet opening 108 to the air inlet opening 110, a simultaneous drying of the air is ensured as said air has a very high moisture content after having passed the apparatus from the air inlet opening 110 to the air outlet opening 109.

When the apparatus according to the invention is used, a continuous length of fabric is loaded into the apparatus through the conveyor band 77 and the associated winches 76 and 70. The fabric is loaded in such a manner that it preferably forms a cable of a diameter of approximately 10 cm, said fabric being a circularly knitted article or knitted or woven lengths of a width of up to approximately 3 m. The continuous cable of fabric is indicated by the reference numeral 111 and is pulled from the conveyor band 77 downwards through the nozzle 51 associated with the first chamber 21, the drying air from the air distribution channel 106 ensuring the necessary driving force. While subjected to a vigorous flow of drying air, the cable 111 passes through the channel 53 while flapping and striking against the walls of the channel 53 and being subjected to both a drying and a mechanical effect. Having passed the channel 53, the fabric 111 passes downwards on the chute 55 therebelow in the chamber 21, whereby the fabric is arranged in transverse folds and slides downwards towards the bottom of the chamber.

Figure 3:
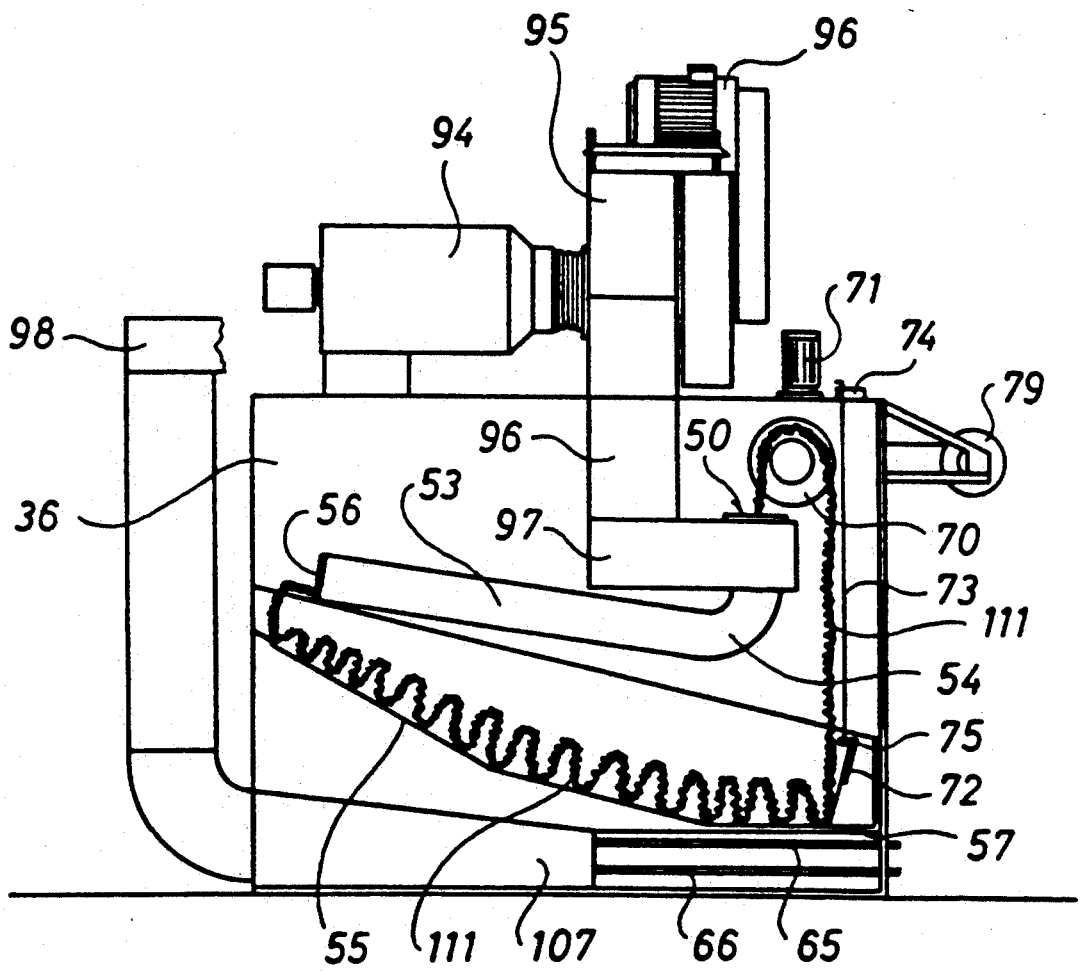
FIG. 3 is a sectional view on a larger scale of the apparatus of FIG. 1 taken along the line III—III of FIG. 1.

FIG. 3 illustrates how the fabric is pulled upwards from the bottom 57 by means of the winch 70 of the succeeding chamber 22 and is sucked downwards again through the succeeding nozzle 51. Subsequently, the fabric is subjected to the same treatment as in the first chamber, and the treatment is repeated in all the following chambers until the fabric reaches the last chamber 44. In the last chamber 44, the fabric is subjected to the fresh air flowing upwards through the chute and the bottom in such a manner that the fabric is cooled before it is lifted upwards from the bottom of the chamber 44 by means of the winches 79 and 81 as well as the associated conveyor band 82 and is finally unloaded from the apparatus.

The drying air is sucked in by means of the first air feeding device 90 through the air inlet opening 110 and is distributed upon heating to the nozzles 71 associated with the chambers 37 to 44. Subsequently, the drying air is sucked out of these chambers and continues to the air feeding device 91 of the chambers 29 to 36, said procedure being followed until it is let out through the air outlet opening 109. It should be noted that the drying air from the first air feeding device 90 which passes the nozzle 51 of the chamber 44 is sucked back again to the air feeding device 90 together with the fresh air through the air suction tube 93. The same procedure applies to the drying air to the nozzle 50 in the chambers 36 and 28. In general, the treatment or drying air moves partially counterstream the fabric and is simultaneously reused in such a manner that a low consumption of air is ensured with the result that energy is saved for the heating thereof.

In each heating device, the air is heated by passing hot surfaces or gas burners in a manner not described in greater detail. The air feeding to the individual groups of chambers is adjusted by means of dampers 112 and temperature sensors 113 placed in the air feeding channel 96, 103, and 104 of each air feeding device 90, 91, 92.

The moving of the fabric through the chambers is controlled by sensors 72, the angular position of which detects the filling degree of the chambers. When a chamber only is filled to an insignificant degree, the corresponding winch 70 is stopped. When the filling degree is usual, the winch 70 is rotated at the desired speed of rotation, and finally when the filling capacity of a chamber is about to be exceeded, the winch is rotated at an additionally high speed with the result that an exceeding of the filling capacity is avoided. The moving speed of the fabric is set in advance at a value corresponding to the character of the fabric to be treated.

At the outlet of the apparatus, an arrangement can be provided for spreading out and suitably folding the fabric.

As the chambers of the apparatus are divided into groups separated by means of partitions 45, 46, and 47, it is possible to adjust and maintain a particular temperature in each group. The groups can, of course, comprise more or less chambers with associated nozzles, and the control of the drying air can be supplemented with hygrometers so as to allow achievement of the optimum utilization of the energy.

As illustrated, the textile material 24 passes inlets with associated nozzles 51 and channels 53, where it is subjected to a vigorous, hot flow of air. Having passed each channel, the fabric is placed in a folded state on the bottom of the chambers where a postevaporation and a relaxation of the fabric takes place before said fabric is again subjected to a flow of air and spread out. The resulting apparatus turned out to provide good results concerning handle and shrinkage at the same time as it involved low heating costs.

The described apparatus is manufactured from the same materials and as far as the individual chambers are concerned with the same dimensions as the apparatuses known within the field in question, and especially the existing apparatuses suited for treatment of separate lengths of fabric.

The invention has been described with reference to the preferred embodiments. Many modifications may, however, be carried out without thereby deviating from the scope of the invention.

We claim:

1. An apparatus for continuously drying and shrinking lengths of textile material, said apparatus comprising a plurality of chambers, in which the textile material is sucked through an inlet by means of drying air and carried along a treatment path to an outlet, and an air feeding device feeding heated drying air to the inlet of the chamber, the textile material being advanced to said inlet by means of a rotating winch, wherein the chambers comprise a plurality of substantially identical chambers (21 to 44) arranged in parallel and interconnected in series wherein the inlet of each chamber (21 to 44) comprises a substantially vertically downward extending nozzle (51) placed below the associated winch (70) and fed with drying air in form of downward jets along the circumference, and a channel (53) with an inlet opening (52) placed immediately below the nozzle (51) and continuing through a curve into an upwardly inclining portion, in which the loosely flapping textile material is advanced by means of the drying air while striking against the walls of the channel (53), and wherein each chamber (21 to 44) comprises a chute (55)

inclining obliquely downwards from a level immediately below the outlet of the channel (53) towards the bottom (57) of the chamber in a direction backwards again towards an area substantially vertically below the nozzle (51) in the inlet (50) of the succeeding chamber (21 to 44), and whereby all the chambers form a treatment path for the textile material (111), and where said chambers are interconnected in such a manner that the textile material is carried in sequence from the outlet of one chamber to the inlet (50) of the succeeding chamber, and wherein said chambers (21 to 44) are arranged in succeeding, mutually separated groups (21 to 27, 28 to 35, 36 to 43, and 44), each group including at least one chamber, and wherein each group comprises an air feeding device feeding heated drying air substantially to all the inlets (50) of the chambers of each group, said air feeding device receiving air from all the chambers of the succeeding group.

2. An apparatus for continuously drying and shrinking lengths of textile material, said apparatus comprising a plurality of chambers, in which the textile material is sucked through an inlet by means of drying air and carried along a treatment path to an outlet, and an air feeding device feeding heated drying air to the inlet of the chamber, the textile material being advanced to said inlet by means of a rotating winch, wherein the chambers comprise a plurality of substantially identical chambers (21 to 44) arranged in parallel and interconnected in series wherein the inlet of each chamber (21 to 44) comprises a substantially vertically downward extending nozzle (51) placed below the associated winch (70) and fed with drying air in form of downward jets along the circumference, and a channel (53) with an inlet opening (52) placed immediately below the nozzle (51) and continuing through a curve into an upwardly inclining portion, in which the loosely flapping textile material is advanced by means of the drying air while striking against the walls of the channel (53), and wherein each chamber (21 to 44) comprises a chute (55) inclining obliquely downwards from a level immediately below the outlet of the channel (53) towards the bottom (57) of the chamber in a direction backwards again towards an area substantially vertically below the nozzle (51) in the inlet (50) of the succeeding chamber (21 to 44), and whereby all the chambers form a treatment path for the textile material (111), and where said chambers are interconnected in such a manner that the textile material is carried in sequence from the outlet of one chamber to the inlet (50) of the succeeding chamber, and wherein said chambers (21 to 44) are arranged in succeeding, mutually separated groups (21 to 27, 28 to 35, 36 to 43, and 44), each group including at least one chamber, and wherein each group comprises an air feeding device feeding heated drying air substantially to all the inlets (50) of the chambers of each group, said air feeding device receiving air from all the chambers of the succeeding group, and wherein the last chamber (44) of the plurality of chambers (21 to 44) is separated from the remaining chambers when seen in the moving direction of the textile material (111) and is provided with a cooling grating (55, 57), the textile material being carried across said cooling grating before it is pulled out of the chamber (44), and wherein the suction air to the air feeding device (90) of the last and the last but one group chambers is sucked in from the outside substantially in form of cold air through the last chamber (44) and the cooling grating (55, 57) thereof.

3. An apparatus as in claims 1 or 2, wherein the chambers of substantially each group of chambers comprise a common bottom (57) allowing the drying air to be sucked away for reuse or into the atmosphere.

* * * * *